United States Patent [19]

Rassey

[11] Patent Number: 4,960,086

[45] Date of Patent: Oct. 2, 1990

[54] ROTARY VALVE CONSTRUCTION UTILIZING A COMPRESSED GAS AS LUBRICANT AND COOLANT

[76] Inventor: Louis J. Rassey, 15711 Twelve Mile Rd., Roseville, Mich. 48066

[21] Appl. No.: 335,730

[22] Filed: Apr. 10, 1989

[51] Int. Cl.[5] ..... F02M 13/00

[52] U.S. Cl. ..... 123/190 DL; 123/190 E

[58] Field of Search ..... 123/190 DL, 190 E, 190 A, 123/80 BA

[56] References Cited

U.S. PATENT DOCUMENTS

| | | | |
|---|---|---|---|
| 867,713 | 10/1907 | Elverson | 123/80 BA |
| 1,189,757 | 7/1916 | Wales | 123/190 E |
| 2,327,470 | 8/1943 | Tjaarda | 123/190 DL |
| 4,036,184 | 7/1977 | Guenther | 123/190 E |
| 4,517,938 | 5/1985 | Kruger | 123/190 E |
| 4,739,737 | 4/1988 | Kruger | 123/190 A |

*Primary Examiner*—Andrew M. Dolinar
*Assistant Examiner*—M. Macy
*Attorney, Agent, or Firm*—Gifford, Groh, Sprinkle, Patmore and Anderson

[57] ABSTRACT

An improved rotary valve construction is provided for use in conjunction with an internal combustion engine of the type having a housing and at least one piston member reciprocally received within a cylinder formed in the housing. In the conventional fashion, fuel intake passage means formed within the housing communicate a combustible fuel mixture to the cylinder while, likewise, exhaust passage means formed in the engine housing expel exhaust gases from the cylinder. A first and second cylindrical valve member, each having a diametric throughbore, are rotatably mounted in the intake passage means and exhaust passage means, respectively. The valve members are rotatably driven in synchronism with the reciprocation of the piston in the cylinder to thereby open the intake and exhaust passage means via the valve member diametric bore at predetermined rotational positions of the valve members. Each valve member is rotatably provided in a valve member bore so that the rotary valve member and the bore have a space therebetween which allows a compressed fuel/air mixture to circulate therebetween, thereby providing cooling and lubrication for the valve by creating a gas bearing. Additionally, each valve member is selectively provided with narrow channels, either knurled or grooved, to thereby provide a labyrinth gland or seal. Ceramic bushings are provided in the bore opposite the channels. Optionally, carbon and rubber or plastic ring seals may be included on either side of each ceramic bushing.

26 Claims, 3 Drawing Sheets

ROTARY VALVE CONSTRUCTION UTILIZING A COMPRESSED GAS AS LUBRICANT AND COOLANT

BACKGROUND OF THE INVENTION

I. Field of the Invention

The present invention relates generally to internal combustion engines and, more particularly, to an improved rotary intake and exhaust valve construction utilizing a compressed fuel/air mixture as coolant, a lubricant, and to provide a gas bearing.

II. Description of the Prior Art

Conventional internal combustion engines include a housing with at least one piston member reciprocally mounted within a cylinder formed in the housing. Fuel intake passage means formed in the housing supply fuel to the cylinder for combustion while, similarly, the exhaust gases from the cylinder pass through exhaust passage means formed in the housing and to the engine exhaust system.

In order to permit the intake of fuel into the cylinder and the expulsion of exhaust gases from the cylinder at the desired engine cyles, an intake vavle and an exhaust valve are provided in the intake and exhaust passage means, respectively. These valves permit fluid flow or communication through their respective passage means upon opening and, conversely, when closed prohibit such fluid flow.

There are many different types of previously-known intake and exhaust valves. One type of previously-known valve member employs a circular closure plate with an axially attached elongated stem. The plate cooperates with a valve seat formed in the housing while a spring attached to the elongated stem normally urges the valve to its closed position. Conversely, opening of the valve is accomplished by depression of the valve stem by a cam, rocker arm, or other appropriate means. This simple type of engine valve, however, is disadvantageous due to its high cost which, in turn, results primarily from the multiplicity of components required for the valve and its actuation. Moreover, these previously known engine valve systems are both heavy and bulky in construction.

A rotary engine valve forms another previously known engine valve in which an elongated cylindrical valve member is rotatably mounted within the engine housing in the fuel intake or exhaust passage means for at least one, and preferably several, engine cylinders. Diametric throughbores are provided through the cylindrical valve member so that upon rotation in synchronism with the internal combustion engine, the valve members permit fluid flow through the intake or exhaust passage means via the diametric throughbore at preselected rotational positions of the valve member.

An improved rotary valve construction is disclosed in my earlier patent, U.S. Pat. No. 4,198,946 as having a valve with internal cooling and improved seals between the engine housing and the rotary valve. More specifically, each valve member of that reference includes at least one axial passageway which is fluidly connected at both ends to the fluid coolant system of the internal combustion engine so that a flow of coolant axially through both valve members is obtained.

Despite the advantages of rotary valves in general and U.S. Pat. No. 4,198,946 specifically, a more efficient and advantageous structure for cooling and lubricating is desirable which would eliminate the need for providing a flow of coolant through the valve members. By eliminating the flow-through of coolant, additional steps related to machining and construction can be eliminated.

Furthermore, the bearing construction of known rotary valves is very expensive and subject to considerable wear. Thus an improved bearing is desirable.

SUMMARY OF THE PRESENT INVENTION

The present invention overcomes the above-mentioned disadvantages of the previously-known rotary engine valves by providing such a valve with a compressed gas which circulates in the space between the valve and its bore to act both as a lubricant and a coolant.

In brief, the rotary valves according to the present invention are both elongated and cylindrical in shape with one valve disposed through the inlet and the other through the exhaust passage means in the engine housing. Each rotary valve is rotatably journalled in its respective passage means and includes a diametric opening for each passageway in the passage means. Consequently, upon rotation, the rotary valve establishes fluid communication through passageways via the diametric openings at predetermined rotational positions of the rotary valve.

The rotary valve of the present invention is fitted into the bore journalled into the valve housing so that a clearance of between .0007 and .0015 is established. With such a clearance a compressed fuel/air mixture is allowed to circulate within the gap. The circulating gas functions as a "gas bearing" to assist in the free rotation of the rotary valve. In essence, the rotary valve is allowed to "float" in the valve bore.

The circulating fuel/air mixture, in addition to providing a "gas bearing", also provides lubrication and cooling.

Beyond the circulating compressed fuel/air mixture providing lubrication and cooling, the present invention also teaches a novel means for providing peripheral spiral channels grooved or knurled about the valve to act as a labyrinth gland or seal. By selectively defining the channels about the periphery of the valve at strategic intervals, glands or seals may be achieved.

To minimize wear and the general effects of heat expansion, a ceramic sleeve is provided in the valve bore at regions facing the channels.

The present invention also discloses a novel means for rotatably driving the rotary valve. In particular, a rotatably mounted shaft is coupled directly to the engine crankshaft by an appropriate gearing arrangement whereby a single gear face simultaneously drives a pair of rotary valves.

As will be more fully understood as the description proceeds, the rotary valve of the present invention is of simple, lightweight, and inexpensive construction. Moreover, due to the peripherally circulating fuel/air mixture, the valve can be directly and effectively cooled and lubricated without liquids. Additionally, because of this construction, bearings may be minimized. Furthermore, the labyrinthine channel construction further requires only minimal use of seals. In addition, the channels aid in lubrication.

BRIEF DESCRIPTION OF THE DRAWINGS

The present invention will be more clearly understood upon reference to the following detailed description when read in conjunction with the accompanying drawing, wherein like reference characters refer to like parts throughout the several views, and in which.

DETAILED DESCRIPTION OF THE PRESENT INVENTION

Figure 1:
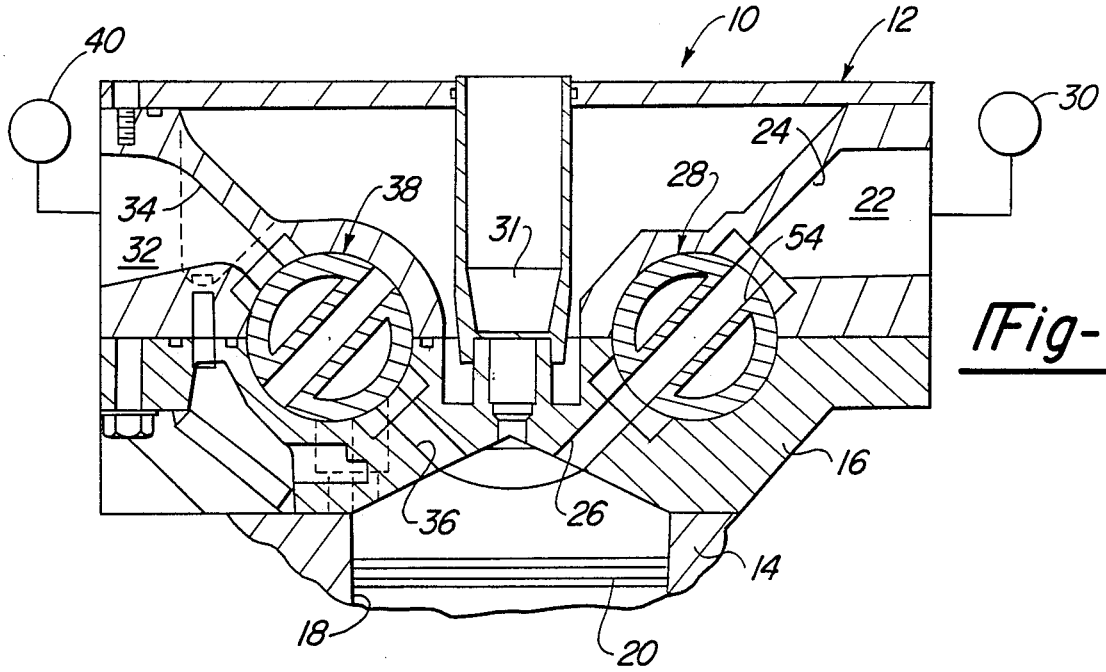
FIG. 1 is a fragmentary sectional view showing the rotary valve construction of the present invention in an engine housing.
Figure 2:
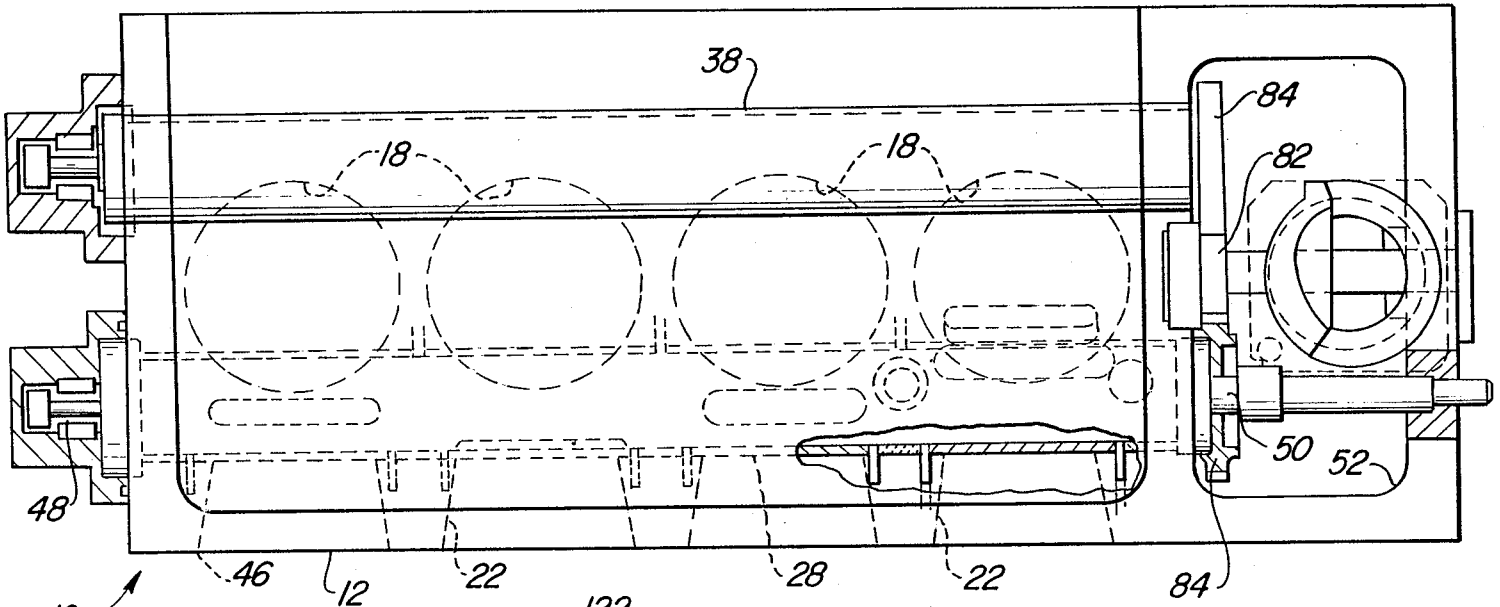
FIG. 2 is a fragmentary, partial sectional top view illustrating an internal combustion engine employing the rotary valve of the present invention.

With reference first to FIGS. 1 and 2, a portion of an internal combustion engine 10 is thereshown having a housing 12. The housing 12 further comprises a block 14 and an upper head assembly 16 detachably connected by means, not shown, to the engine block 14. Typically, the engine valve means which will subsequently be described in greater detail, are contained within the head assembly 16 while one or more cylinders 18 are formed within the engine block 14 and are adapted to reciprocally receive a piston member 20 therein. Each piston member 20 in turn is connected at its lower end to a crankshaft (not shown) by appropriate piston rod means (not shown). Moreover, by way of example only, the internal combustion engine 10 shown in FIGS. 1 and 2 of the drawing incorporates four in-line cylinders 18, it being understood, of course, that the provision of more or less cylinders 18 remains within the scope and spirit of the invention.

A fuel intake passage means 22 comprising a first section 24 and a second section 26 is formed through the head assembly 16 with a rotary intake valve 28, according to the present invention, disposed between the intake passage sections 24 and 26. The passage section 24 is coupled at its outer end to appropriate carburetor means 30 while the inner end of the passage section 26 is open to the cylinder 18. Thus, with the valve 28 in its open position, the piston 20 inducts a fuel mixture from the carburetor means 30 into the cylinder 18 during the conventional downward intake cycle of the piston 20. Conventional ignition means 31 are provided for igniting the fuel mixture in the cylinder 18.

Exhaust passage means 32 comprising a first section 34 and a second section 36 are also formed through the head assembly 16 with a rotary exhaust valve 38 according to the present invention, disposed between the exhaust passage sections 34 and 36. The outer end of the exhaust passage section 34 is coupled to an appropriate engine exhaust system 40 while the inner end of the exhaust section 36 is open to the cylinder 18. Thus, with the exhaust rotary valve 38 in its open position, exhaust fumes from the fuel combustion are expelled through the exhaust passageway 32 and exhaust valve 38 during the conventional upward exhaust cycle of the piston 20.

Figure 3:
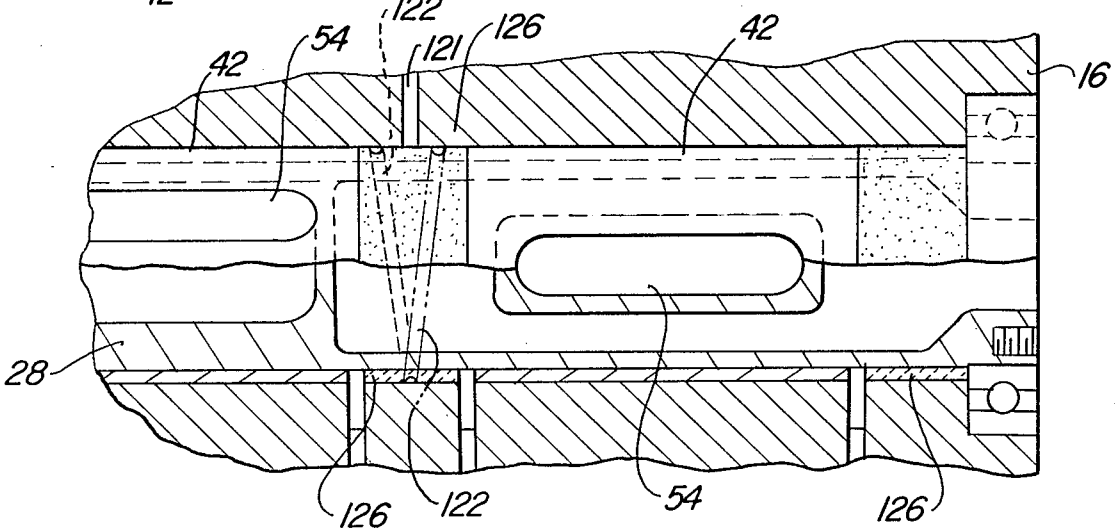
FIG. 3 is a fragmentary, partial sectional view illustrating the rotary valve of the present invention in detail.

With reference now to FIGS. 1, 2 and 3, the intake rotary valve 28 and exhaust rotary valve 38 are substantially identical to each other so that, for brevity, only the intake rotary valve 28 will be described in detail, it being understood, of course, that the description also applies to the exhaust rotary valve 38. The rotary valve 28 is elongated and cylindrical in cross-sectional shape and includes a cylindrical valve portion 42 respectively disposed in the intake passage means 22 for each cylinder 18. The rear end 48 of the rotary valve 28 protrudes outwardly from the housing 12 while the other axial end 50 of the valve 28 protrudes into a cavity 52 formed in the housing 12.

As best shown in FIGS. 1 and 3, each valve portion 42 includes an axially oblong diametric throughbore 54 so that the valve 28 permits fluid communication between the intake passage sections 24 and 26 when the throughbore 54 is in alignment with the sections 24 and 26, as best shown in FIG. 1. The throughbore 54 is particularly wide to provide a better fuel/air mix because the charge is more directed into the combustion chamber. Conversely, of course, the rotary valve 28 obstructs and prohibits fluid flow from the passage section 24 to the section 26 when the rotary valve 28 is rotated to a position in which the oblong throughbore 54 is not in registry with the passage sections 24 and 26. It will also be appreciated that the angular positions of the throughbores 54 relative to each other will vary from one valve portion 42 to the other as required by the cylinder combustion sequence of the particular internal combustion engine 10.

The valve 28 is disposed within the head assembly 16 such that a clearance of between .0007 and .0015 is provided between the bores of the head assembly 16 and the periphery of the valve 28. By the provision of such a clearance compressed fuel/air, piloted from the fuel/air mixture compressed by the compression stroke of a cylinder via fuel/air lines 121, is able to circulate around the periphery of the valve 28, thereby providing a compressed lubricating and cooling fuel/air mixture which acts as an air bearing to assist in the proper free rotation of the valve 28.

Figure 4:
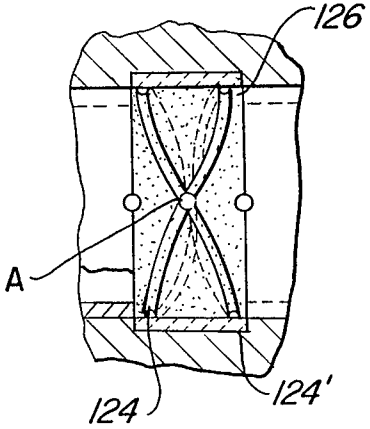
FIG. 4 is a view detailing the configuration of the rotary valve's fuel/air channel according to the present invention.

To provide seals between the valve portions 42 and to thereby limit the travel of combusting fuel/air about the valve, spiral channels are selectively defined in the valve 28. With particular reference to FIG. 3, a spiral channel 122 is illustrated defined about the periphery of the valve 28. With reference to FIG. 4, a pair of channels 124, 124' are provided. The channels 122, 124, 124' may be either knurled or grooved.

Although as illustrated in FIG. 3 the fuel/air line 121 is not venting compressed gas into the channel, as can be seen by channel 122, if the valve 28 was to be rotated 180°, the line 121 would be venting directly into the channel 122. Referring to FIG. 4, an intersection of channels 124 and 124', generally indicated as "A", is the position on the rotating face of the valve 28 wherein the line 121 would vent into the channels 124, 124'.

The construction of channels 122 or 124, 124' are provided to minimize leakage of the fuel/air mixture longitudinally along the valve 28 from one valve portion 42 to the next. The labyrinthine design of the channels 122 and 124, 124' acts as a seal in that the compressed fuel/air mixture is substantially trapped in the channels and a turbulent mass of the mixture is created in the channels. Accordingly, compressed fuel/air mixture piloted off from one cylinder during its compression stroke does not leak over into the neighboring valve portion 42.

Although the present construction provides a particular advantage in that a seal is accomplished by the channels 122, 124, 124', the turbulence created in the channels 122, 124, 124' tends to create heat in the intermediate environment. Accordingly, in the bore hole for the valve 28 immediately about the channels 122, 124, 124' are provided a number of ceramic bushing 126.

From the foregoing, it can be seen that during engine operation a continuous flow of circulating compressed fuel/air mixture is piloted off from the cylinder to circulate about the valve 28. Cooling and lubrication is accomplished thereby, creating a cooled gas bearing within which the valve 28 freely rotates. To seal one valve portion 42 from another portion 42, the channels 122, 124, 124' are provided to create a labyrinth seal. This construction prevents leakage of combusting fuel/air from cylinder to cylinder.

Figure 6:
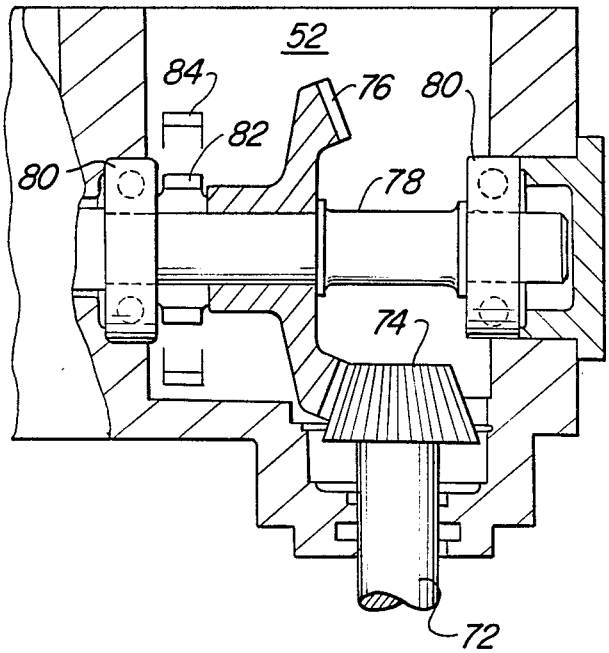
FIG. 6 is a fragmentary, partial sectional side view showing the means for rotatably driving the rotary valve of the present invention and enlarged for clarity.

With reference now particularly to FIGS. 2 and 6, the means for rotatably driving the intake and exhaust rotary valves 28 and 38, respectively, is thereshown and comprises a vertical shaft 72 having an upper end extending into and rotatably journalled within the cavity 52. The lower end of the shaft 72 is coupled with and rotatably driven by the crankshaft (not shown) of the engine 10.

A bevel gear 74 is secured to the upper end of the shaft 72 and meshes with a cooperating bevel gear 76 coupled to a stub shaft 78 and rotatably journalled by ball bearing means 80 within the housing cavity 52. Still referring to FIGS. 2 and 6, a small spur gear 82 is likewise coupled to the stub shaft 78 for rotation therewith immediately adjacent the bevel gear 76. The spur gear 82 in turn meshes with a pair of larger spur gears 84 secured onto the front end 50 of both the intake and exhaust valves 28 and 38, respectively.

By this arrangement, rotation of the shaft 72 by the engine crankshaft in turn simultaneously rotatably drives both the intake and exhaust valves 28 and 38.

It will also be appreciated that the proper gearing ratios between the gears 74, 76, and 82 and 84 will, of course, depend upon the particular type of internal combustion engine 10. For example, in a conventional four-cycle engine a one-half rotation of each rotary valve 28 and 38 would be required for every two rotations of the engine crankshaft. It will also be appreciated that the rotary valves 28 and 38 are rotatably driven in the opposite rotational directions, but due to the diametric nature of the oblong throughbores 54, the correct opening sequence for the valve 28 and 38 is obtained regardless of their direction of rotation.

Figure 5:
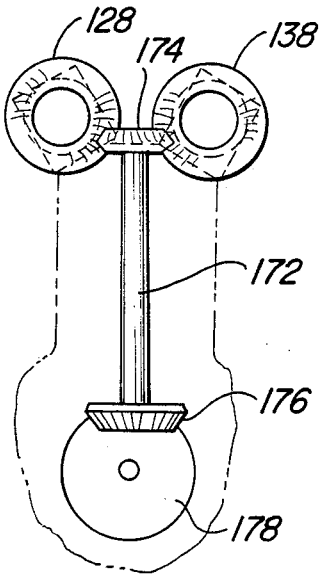
FIG. 5 is a fragmentary, raised elevational view illustrating the means for driving a pair of rotary valves by a common take off shaft according to the present invention.

With reference to FIG. 5, an alternate embodiment of the means for rotatably driving the intake and exhaust rotary valves 28 and 38, respectively, is thereshown and comprises a vertical shaft 172 having an upper bevel gear 174 and a lower bevel gear 176. The lower bevel gear 176 is rotatably driven by a crankshaft bevel gear 178 provided at one end of the crankshaft (not shown).

The upper bevel gear 174 meshes with a pair of cooperating valve bevel gears 128, 138, each provided at the end of the intake and exhaust rotary valves 28 and 38, respectively. By this arrangement, rotation of the crankshaft bevel gear 178 by the engine crankshaft in turn simultaneously rotatably drives both the intake and the exhaust valves 28 and 38.

The rotary valve construction of the present invention thus achieves several important advantages over the previously-known rotary valves. In particular, the peripheral cooling and lubricating of the valves 28 and 38 provide a simple and yet effective means for efficiently providing a cooled valve and a lubricated compressed gas bearing. As such, expensive and complex cooling and bearing designs are effectively eliminated.

In addition, the labyrinth seal provided by the spiral channels 122, 124, 124' eliminates spill-over of compressed gas from one valve portion 42 to another.

Figure 7:
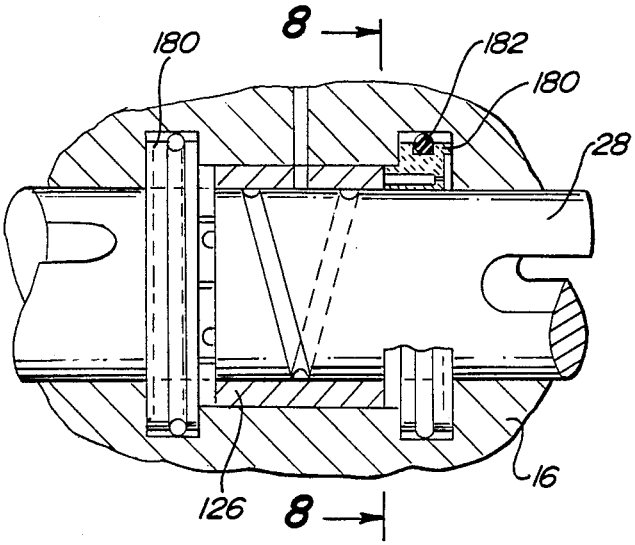
FIG. 7 is a view detailing the seal construction of an alternate embodiment of the present invention in partial sectional view.
Figure 8:
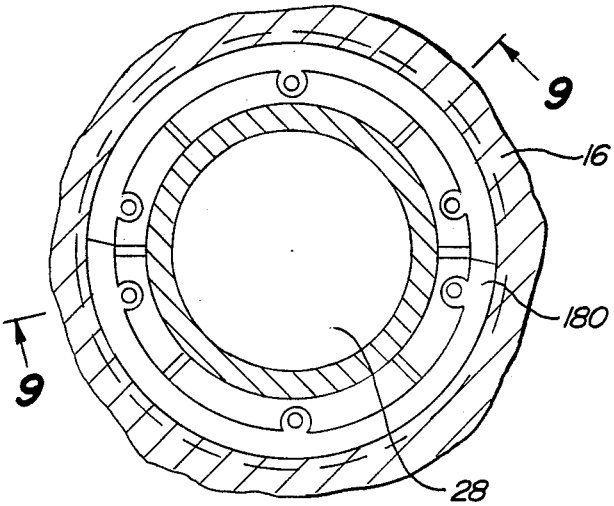
FIG. 8 is a cross-sectional view along line 8—8 of FIG. 7.
Figure 9:
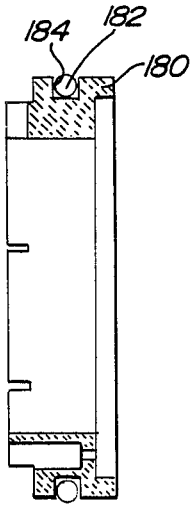
FIG. 9 is a cross-sectional view along line 9—9 of FIG. 8.

To further prevent spill-over, an alternate embodiment of the present invention is shown in FIGS. 7–9. With reference thereto, a view is shown illustrating a valve, such as the intake valve 28, rotatably housed within head assembly 16. The ceramic bushing 126 is also illustrated. In this embodiment, a sealing ring 180 is included and is fitted in a channel defined in the head assembly 16. The sealing ring 180 is preferably composed of a carbon or a carbon compound to provide a high heat resistance. Peripherally fitted about the sealing ring 180 is a rubber or plastic ring washer 182 fitted within a channel 184 defined about the sealing ring 180.

Having described my invention, many modifications thereto will become apparent to those skilled in the art to which it pertains without deviation from the spirit of the invention as defined by the appended claims.

I claim:

1. In an internal combustion engine of the type having a housing with at least one cylinder formed in the housing, at least one piston member reciprocally received in said cylinder, passage means formed in said housing for communicating a combustible mixture to said cylinder and for expelling exhaust gases from said cylinder, and at least one cylindrical rotary valve member rotatably housed substantially in a bore journalled in said housing, said rotary valve member having a diametric throughbore so that said rotary valve means selectively establishes fluid communication through said passage means at predetermined rotational positions of said rotary valve means, each of said rotary valve members have defined therein one or more peripheral channels, said one or more peripherally defined channels comprising a labyrinth, the improvement which comprises:

gas means for lubricating said rotary valve means; and said gas means for lubricating including said bore and said rotary valve having a first toleranced diameter and a second toleranced diameter of a predetermined amount whereby a gas may circulate therebetween.

2. In an internal combustion engine of the type having a housing with at least one cylinder formed in the housing, at least one piston member reciprocally received in said cylinder, passage means formed in said housing for communicating a combustible mixture to said cylinder and for expelling exhaust gases from said cylinder, and at least one cylindrical rotary valve member rotatably housed substantially in a bore journalled in said housing, said rotary valve member having a diametric throughbore so that said rotary valve means selectively establishes fluid communication through said passage means at predetermined rotational positions of said rotary valve means, each of said rotary valve members have defined therein one or more peripheral channels, said one or more peripherally defined channels comprising a labyrinth, wherein at least one pair of said labyrinth channels cross one another, the improvement which comprises:

gas means for lubricating said rotary valve means; and said gas means for lubricating including said bore and said rotary valve having a first toleanced diameter and a second toleranced diameter of a predetermined amount whereby a gas may circulate therebetween.

3. The invention as defined in claim 2 wherein said gas comprises a compressed fuel/air mixture.

4. The invention as defined in claim 3 wherein said means for lubricating is also bearing means.

5. The invention as defined in claim 3 wherein said means for lubricating is also cooling means.

6. The invention as defined in claim 1 further comprising:

each of said rotary valve members having channel regions provided substantially between said cylinders, said channel regions having defined therein one or more peripheral channels; and a plurality of ceramic members provided in said bore facing said channel regions.

7. In an internal combustion engine of the type having a housing with at least one cylinder formed in said housing, at least one piston member reciprocally received in said cylinder, at least one cylindrical rotary valve member rotatably housed in a bore journalled in said housing, each said at least one cylindrical rotary valve having at least one throughbore formed substantially diametrically therethrough, fuel intake passage means formed in said housing for communicating a combustible mixture to said cylinder, ignition means for igniting said combustible mixture in said cylinder, and exhaust passage means formed in said housing for expelling exhaust gases from said cylinder, the improvement whcih comprises:

means for rotatably mounting said at least one valve member in said bore so that each said valve member establishes fluid communication through its respective intake passage means and exhaust passage means through its respective diametric throughbore at predetermined rotational positions of said valve members;

means for rotatably driving said valve members in synchronism with the reciprocation of said piston member;

means for lubricating said rotary valve means;

said means for lubricating employing said combustible mixture in the form of a gas; and said means for lubricating including said bore and said rotary valve having a tolerance of a predetermined amount whereby said gas may selectively circulate therebetween.

8. The invention as defined in claim 7 wherein said rotatable driving means further comprises:

a pair of driven gears, one driven gear being coupled to one end of each valve member;

a shaft and means for rotatably driving one end of said shaft in synchronism with the reciprocation of said piston member in said cylinder; and gear means coupled to the other end of said shaft for simultaneously rotatably driving said driven gears.

9. In an internal combustion engine of the type having a housing with at least one cylinder formed in said housing, at least one piston member reciprocally received in said cylinder, at least one cylindrical rotary valve member rotatably housed in a bore journalled in said housing, each said at least one cylindrical rotary valve having at least one throughbore formed substantially diametrically therethrough, fuel intake passage means formed in said housing for communicating a combustible mixture to said cylinder, ignition means for igniting said combustible mixture in said cylinder, and exhaust passage means formed in said housing for expelling exhaust gases from said cylinder, the improvement which comprises:

means for rotatably mounting said at least one valve member in said bore so that each said valve member establishes fluid communication through its respective intake passage means and exhaust passage means through its respective diametric throughbore at predetermined rotational positions of said valve members;

each of said rotary valve members have defined therein one or more peripheral channels, said one or more peripherally defined channels comprise a labyrinth;

means for rotatably driving said valve members in synchronism with the reciprocation of said piston member;

means for lubricating said rotary valve means;

said means for lubricating employing a gas; and said means for lubricating including said bore having a first toleranced diameter and said rotary valve having a second toleranced diameter of a predetermined amount whereby a gas may selectively circulate therebetween.

10. The invention as defined in claim 9 wherein at least a pair of said labyrinthine channels cross one another.

11. The invention as defined in claim 10 wherein said gas comprises a compressed fuel/air mixture.

12. The invention as defined in claim 11 wherein said means for lubricating is also bearing means.

13. The invention as defined in claim 11 wherein said means for lubricating is also cooling means.

14. The invention as defined in claim 7 including sealing means for fluidly sealing said valve members to said engine housing.

15. The invention as defined in claim 9 wherein said channels are knurled.

16. The invention as defined in claim 9 wherein said channels are grooved.

17. The invention as defined in claim 7 further comprising:

each of said rotary valve members having channel regions provided substantially between said cylinders, said channel regions having defined therein one or more peripheral channels; and a plurality of ceramic members provided in said bore facing said channel regions.

18. The invention as defined in claim 8 wherein said pair of driven gears are bevelled.

19. The invention as defined in claim 9 further including means for supplying pressurized fluid to said channels.

20. The invention as defined in claim 19 wherein said means for supplying pressurized fluid includes:

compressed fuel/air piloted off of one or more of said cylinders; and means for venting said compressed fuel/air into said channels.

21. The invention as defined in claim 20 wherein said compressed fuel/air is piloted off of one of said cylinders as said piston member in said cylinder substantially achieves its compression stroke.

22. In an internal combustion engine of the type having a housing with at least one cylinder formed in the housing, at least one piston member reciprocally received in said cylinder, and at least one cylindrical rotary valve member rotatably substantially housed in a bore journalled in said housing, the improvement which comprises:

means for lubricating said rotary valve means;

said means for lubricating including said bore and said rotary valve having a tolerance of a predetermined amount whereby a gas may circulate therebetween;

each of said rotary valve members having channel regions provided substantially between said cylinders, said channel regions having defined thereon one or more peripheral channels; and a plurality of ceramic members provided in said bore facing said channel regions.

23. The invention as defined in claim 22 further includes at least one sealing ring rotatably fitted on said rotary valve adjacent to said ceramic members.

24. The invention as defined in claim 23 wherein each of said ceramic members has two sides, one of said sealing rings being provided at each of said sides.

25. The invention as defined in claim 23 wherein said sealing ring comprises a seal body and a peripheral ring.

26. The invention as defined in claim 25 wherein said body is composed of a carbon compound.

* * * * *